US007401647B2

(12) United States Patent
Baycroft et al.

(10) Patent No.: US 7,401,647 B2
(45) Date of Patent: Jul. 22, 2008

(54) FLUSH MOUNTED TUBULAR PATCH

(75) Inventors: Perry D. Baycroft, Houston, TX (US); Elmer R. Peterson, Porter, TX (US); Steve Rosenblatt, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 248 days.

(21) Appl. No.: 11/273,658

(22) Filed: Nov. 14, 2005

(65) Prior Publication Data

US 2007/0107898 A1 May 17, 2007

(51) Int. Cl.
*E21B 43/10* (2006.01)
*E21B 29/10* (2006.01)

(52) U.S. Cl. ..... 166/277; 166/384; 166/207; 138/98; 29/402.09

(58) Field of Classification Search ..... 166/277, 166/384, 207, 55; 138/98; 29/402.09, 235, 29/451
See application file for complete search history.

(56) References Cited

U.S. PATENT DOCUMENTS 2,214,226 A * 9/1940 English ..... 166/277
3,067,801 A * 12/1962 Sortor ..... 29/522.1
3,167,122 A * 1/1965 Lang ..... 166/277
3,191,677 A * 6/1965 Kinley ..... 166/277
3,967,681 A 7/1976 Curzon
5,227,124 A 7/1993 Saito et al.
5,267,279 A 11/1993 Saito et al.
5,829,524 A 11/1998 Flanders et al.
6,250,385 B1 6/2001 Montaron
6,668,930 B2 * 12/2003 Hoffman ..... 166/298
6,688,400 B2 * 2/2004 Metcalfe et al. ..... 166/387
7,017,670 B2 * 3/2006 Hazel et al. ..... 166/382
2002/0145281 A1 * 10/2002 Metcalfe et al. ..... 285/206
2003/0102127 A1 6/2003 Braddick

* cited by examiner

*Primary Examiner*—Kenneth Thompson
(74) *Attorney, Agent, or Firm*—Steve Rosenblatt

(57) ABSTRACT

Casing or other well tubulars that have failed are repaired in a manner that doesn't reduce the final inside diameter and doesn't further propagate the failure. The tubular needing repair is first expanded on at least one zone above and below the damaged area. This expansion in an undamaged area arrests failure propagation when the damaged area is then expanded. After the damaged area is expanded, the patch coupled preferably with exterior seals is positioned in the expanded zone of the damaged tubular and expanded. The procedure can also be accomplished in a single trip into the well.

14 Claims, 1 Drawing Sheet

FLUSH MOUNTED TUBULAR PATCH

FIELD OF THE INVENTION

The field of this invention is tubular patches applied by expansion and more particularly those that result in a flush mounting of the patch so that the internal diameter of the well is not reduced from patching.

BACKGROUND OF THE INVENTION

Downhole well tubulars sometimes develop leaks and need to be repaired. On technique to make such a repair is called cement squeezing. In this technique, cement is pumped into an isolated zone and hopefully into the damaged portions and the cement is allowed to set up. After setup the excess cement is drilled out of the wellbore and the repair is pressure tested to see if it has been successful. If it still fails to hold pressure the process can be repeated as many times as necessary until pressure integrity is regained. This process can work but it is extremely time consuming and could get very expensive if ultimately it doesn't work in a particular application. The cement is brittle and can break over time. These types of patches are difficult to make in a short interval and progressively get more problematic with a longer interval.

Another technique is to place a patch in the area of the damaged tubular and expand the patch into a sealing relationship. This technique is well known and it will also reduce the inside diameter of the wellbore.

What is needed and provided by the present invention is a technique for patching a tubular downhole without reducing the inside resulting diameter and without aggravating the existing failure in the tubular that has brought the need to apply a patch. The details of the method will be more readily understood by those skilled in the art from a review of the description of the preferred embodiment and the claims that appear below.

SUMMARY OF THE INVENTION

Casing or other well tubulars that have failed are repaired in a manner that doesn't reduce the final inside diameter and doesn't further propagate the failure. The tubular needing repair is first expanded on at least one zone above and below the damaged area. This expansion in an undamaged area arrests failure propagation when the damaged area is then expanded. After the damaged area is expanded, the patch coupled preferably with exterior seals is positioned in the expanded zone of the damaged tubular and expanded. The procedure can also be accomplished in a single trip into the well.

DETAILED DESCRIPTION OF THE DRAWINGS

DETAILED DESCRIPTION OF THE PREFERRED EMBODIMENT

Figure 1:
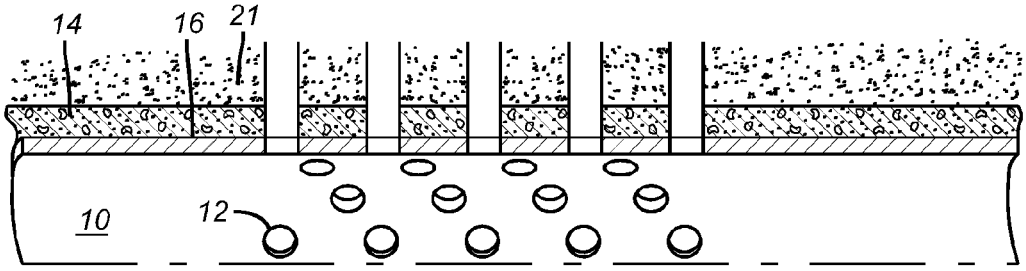
FIG. 1 shows a section of a damaged tubular downhole.

FIG. 1 shows a casing 10 that is either damaged itself or has damage in the adjacent perforations 12. There is cement 14 around the casing 10 in the welibore 16. As a first step in the method an undamaged zone 18 is expanded. Zone 18 can be above the damaged area 20 or it can be below or it can be both above and below. Preferably, when expanding bottom up the zone 18 is uphole from the damaged area 20. Expanding zone 18 will require expansion of the cement 14 and the formation 21 beyond it. The formation beyond can be rock that will expand but the higher the pore pressure, Young's modulus and Poisson's ratio, the harder will it be to accomplish the expansion. This makes formations with lower reservoir pressure, Young's modulus and Poisson's ratio more likely candidates for the method.

Figure 2:
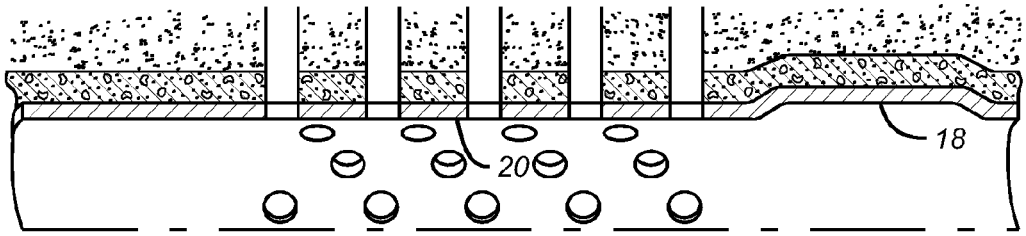
FIG. 2 is the view of FIG. 1 showing expansion above the damaged section.

The reason an undamaged zone on either or both sides of a damaged zone is expanded first is that a failure or crack that defines the damaged zone will want to propagate if the damaged portion itself is initially expanded. Using the initial expansion in the undamaged zone acts as a stop to crack propagation. This step is illustrated in FIG. 2.

Figure 3:
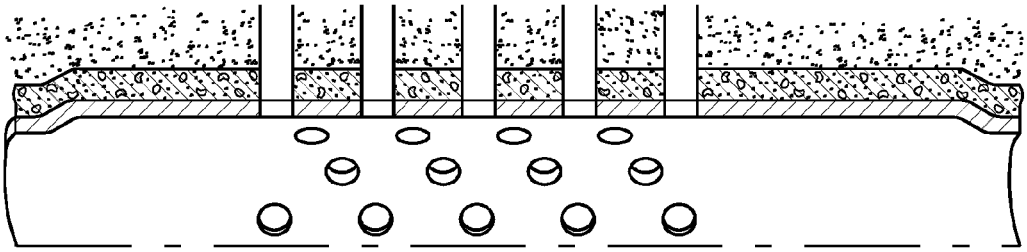
FIG. 3 is a view of FIG. 2 showing the expansion of the damaged zone.
Figure 4:
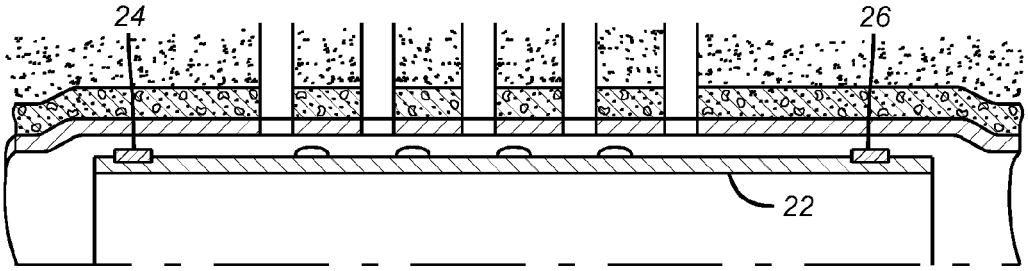
FIG. 4 is the view of FIG. 3 showing the placement of the patch in position.
Figure 5:
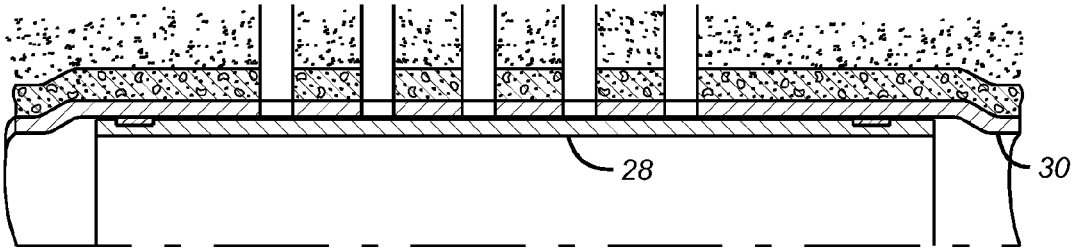
FIG. 5 is the view of FIG. 4 showing the patch with exterior seals expanded into sealing position in the damaged zone.

FIG. 3 illustrates expansion of the damaged zone 20 after one or more undamaged zones 18 have been expanded. Ideally, the damaged zone 20 is expanded to the same diameter of the previously expanded undamaged zone 18 so that in FIG. 3 they appear to be a single expanded zone. While the separate expansions do not need to be exactly to the same degree, this is likely to occur especially if the technique employed has expansion starting in zone 18 and continuing in the same direction into zone 20. Those skilled in the art can appreciate that zone 18 can be expanded in one direction while zone 20 can be expanded in the same or the opposite direction. Alternatively, with certain expansion techniques such as using an inflatable there may be no direction of expansion if the inflatable is long enough to cover an entire zone in a single inflation. One way the expansion can take place is with a variable diameter swage that con do an undamaged zone 18 above or/and below the damaged zone 20 and then be collapsed and repositioned to go into the damaged zone to complete that expansion.

FIG. 3 shows the two zones of expansion on the tubular 10 having been concluded and now ready to accept a patch 22 that is shown with external seals 24 and 26. In the final step, the patch 22 is expanded to an inside diameter 28 that is preferably at least as large as the original well diameter 30. The patch 22 is shown sealed against the tubular 10. The seals 24 and 26 are understood to be optional. The patch 22 is shown as a single piece but can be in sections. The above procedure is shown in a single well location but can be used in multiple locations within the well. While a cemented tubular is shown, the presence of cement is for background purposes and the method is equally available in the case of uncemented tubulars.

The illustrated method can also be accomplished in a single trip using a single or multiple swage devices. The patch is simply run in and temporarily supported from the run in string. An adjustable swage and related anchor and stroker are suspended below on the running string. The initial expansion of zones 18 and 20, as described above, are accomplished. The swage is then repositioned adjacent the joined expansion zones that are shown in FIG. 3. The temporary support for the patch on the run in string is released allowing the patch to drop down against the swage and relatch to the run in string until the initial expansion of the patch anchors it at which time the latch can be overcome or otherwise released to allow the swage to pass through the patch and the entire assembly can be retrieved to the surface. Alternatively, multiple swages can be used with multiple anchor/strokers to actuate each swage separately. Initially, the damaged tubular is expanded as described above using hydraulic pressure that leaves the other anchor and stroker inoperative. After the damaged tubular is expanded as described above, the patch is placed into position in the previously expanded area and a ball is dropped to now make the second anchor and stroker assembly active while isolated the initial anchor and stroker. The patch is then expanded and the entire assembly removed from the well. In either case the method is accomplished in a single trip because the damaged casing is expanded and the patch is delivered and expanded all in a single trip.

The above description is illustrative of the preferred embodiment and many modifications may be made by those skilled in the art without departing from the invention whose scope is to be determined from the literal and equivalent scope of the claims below.

We claim:

1. A method of sealing a tubular located downhole without reduction of its internal diameter, comprising:

initially expanding the tubular located downhole in an undamaged zone;

subsequently expanding the damaged zone of the tubular;

subsequently to expanding the damaged zone of the tubular, expanding a patch into the previously expanded damaged zone of the tubular located downhole.

2. The method of claim 1, comprising:

performing both said expansions in a single trip into the wellbore.

3. The method of claim 2, comprising:

using at least one swage to perform said expansions.

4. The method of claim 1, comprising:

expanding said patch to the point where its internal diameter is at least as large as the unexpanded portions of the tubular located above or below it downhole.

5. The method of claim 1, comprising:

preventing aggravation of damage to the tubular located downhole before expanding it.

6. The method of claim 1, comprising:

performing said initially expanding in at least one undamaged zone of the zones above and below said damaged zone.

7. The method of claim 6, comprising:

performing said initial and subsequent expansions in the same direction.

8. The method of claim 1, comprising:

abutting said damaged and undamaged zones; and spanning said zones with patch.

9. The method of claim 8, comprising:

proving at least one exterior resilient seal on said patch.

10. A method of sealing a tubular located downhole without reduction of its internal diameter, comprising:

initially expanding the tubular located downhole;

subsequently expanding a patch into the previously expanded tubular located downhole;

initially expanding the tubular located downhole in an undamaged zone;

subsequently expanding the tubular located downhole in a damaged zone;

performing said initially expanding in at least one undamaged zone of the zones above and below said damaged zone;

performing said initial and subsequent expansions in opposite directions.

11. A method of sealing a tubular located downhole without reduction of its internal diameter, comprising:

initially expanding the tubular located downhole;

subsequently expanding a patch into the previously expanded tubular located downhole;

performing both said expansions in a single trip into the wellbore;

using at least one swage to perform said expansions;

delivering said swage and said patch on a running string;

repositioning said patch after said initially expanding;

using said swage to subsequently expand said patch after said repositioning.

12. The method of claim 11, comprising:

using more than one swage for said initial and subsequent expanding.

13. The method of claim 3, comprising:

using a variable diameter swage for said expansions.

14. A method of sealing a tubular located downhole without reduction of its internal diameter, comprising:

initially expanding the tubular located downhole; subsequently expanding a patch into the previously expanded tubular located downhole;

preventing aggravation of damage to the tubular located downhole before expanding it;

arresting crack propagation in the tubular mounted downhole by initially expanding it adjacent an undamaged portion.

* * * * *